US006504890B1

(12) United States Patent
Cheng

(10) Patent No.: US 6,504,890 B1
(45) Date of Patent: Jan. 7, 2003

(54) CASH COUNTING APPARATUS FOR CASHBOX

(76) Inventor: Jer-Ming Cheng, 5F-6, No. 482, Sec. 5, Chung-Hsiao E. Road, Taipei (TW)

( * ) Notice: Subject to any disclaimer, the term of this patent is extended or adjusted under 35 U.S.C. 154(b) by 0 days.

(21) Appl. No.: 10/108,493

(22) Filed: Mar. 29, 2002

(51) Int. Cl.[7] ..... G06M 11/00

(52) U.S. Cl. ..... 377/7; 235/425; 453/30; 453/32; 453/33; 453/58

(58) Field of Search ..... 377/7; 453/30, 453/33, 58, 32; 235/425

(56) References Cited

U.S. PATENT DOCUMENTS 1,932,014 A * 10/1933 Frankford ..... 194/6

4,667,689 A * 5/1987 Kohashi ..... 453/58

* cited by examiner

*Primary Examiner*—Margaret R. Wambach

(57) ABSTRACT

A cash counting apparatus for cashbox comprises a case arranged within the cashbox, a sliding block movably arranged at an upper side of the case, a swing arm pivotally arranged in the case, and a circuit board with a plurality of contacts. The swing arm has one end pivotally driven by the sliding block and a probe on another end. The sliding block is moved laterally by an inserted coin, and the probe is swung due to the lever action of the swing arm. The probe is selectively in contact with one of the contacts according to the sizes of the inserted coin.

5 Claims, 3 Drawing Sheets

CASH COUNTING APPARATUS FOR CASHBOX

BACKGROUND OF THE INVENTION

1) Field of the Invention

The present invention relates to a cash counting apparatus for cashbox, especially to ash counting apparatus for cashbox, which can automatically count the value of inserted coin.

2) Description of the Prior Art

The conventional cash box generally comprises a box and a money slot. The cash money saved in the cash box is counted manually after the box is full. To save manual power, an electrical sifter is developed, wherein different sensors are provided for channels through which different coins pass. The electrical sifter comprises a turntable driven by motor, which has complicated structure and counting error is frequently occurred.

SUMMARY OF THE INVENTION

It is an object of the present invention to provide a cash counting apparatus for cashbox, which can automatically count the value of inserted coin.

It is another object of the present invention to provide a cash counting apparatus for cashbox, which can inform the value of inserted coin by music or numeric display.

To achieve above object, the present invention provides a cash counting apparatus for cashbox, which comprises a case arranged within the cashbox, a sliding block movably arranged at an upper side of the case, a swing arm pivotally arranged in the case, and a circuit board with a plurality of contacts. The swing arm has one end pivotally driven by the sliding block and a probe on another end. The sliding block is moved laterally by an inserted coin, and the probe is swung due to the lever action of the swing arm. The probe is selectively in contact with one of the contacts according to the sizes of the inserted coin.

The various objects and advantages of the present invention will be more readily understood from the following detailed description when read in conjunction with the appended drawing, in which:

DETAILED DESCRIPTION OF THE PREFERRED EMBODIMENTS

Figure 1:
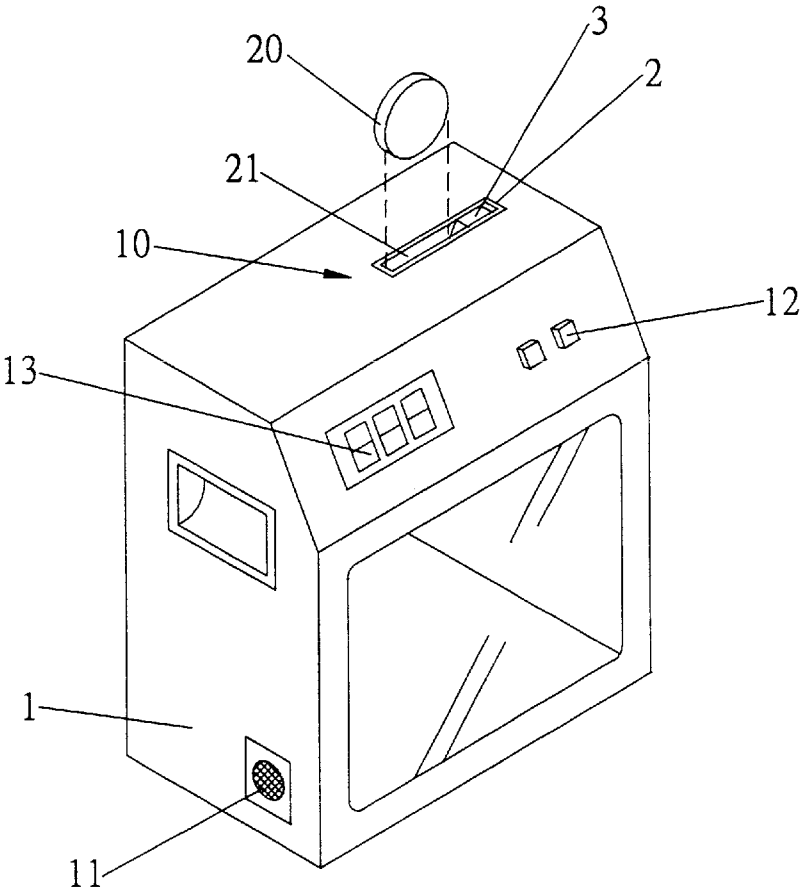
FIG. 1 shows a cashbox with a cash counting apparatus of the present invention.

FIG. 1 shows a cashbox with a cash counting apparatus of the present invention. The cash counting apparatus of the present invention can count the value of the inserted coin by the size of the coins. The cashbox with the cash counting apparatus comprises a box 1, a numeric display 13, a sum button 12 and a loudspeaker 11. The total money in the box 1 is known by pressing the sum button 12 and the total value is displayed on the numeric display 13 or announced through the loudspeaker 11.

The counting apparatus of the present invention comprises a slot 21 on the top face of the box 1, the coin 20 slides over a sliding block 3 on the circumference thereof when it is inserted through the slot 21.

Figure 2:
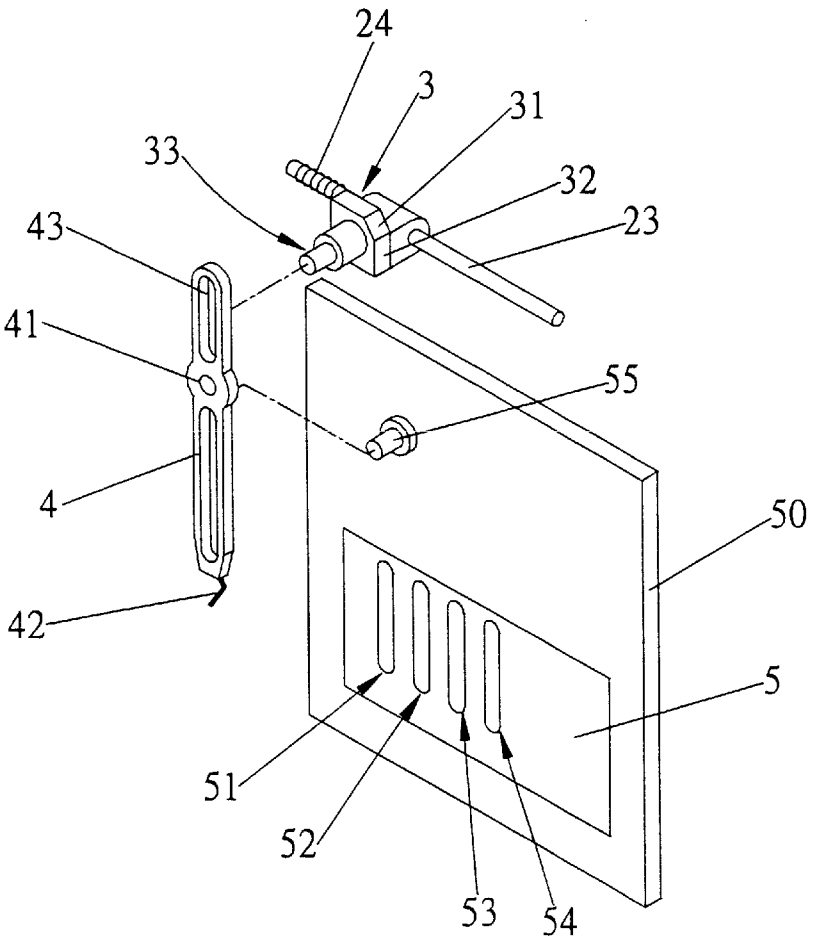
FIG. 2 shows an exploded view of the cash counting apparatus of the present invention.

As shown in FIG. 2, the sliding block 3 has a bevel 31 and a pushing face 32 adjacent to the bevel 31. A driving pin 33 extends from one face of the sliding block 3. The sliding block 3 is arranged on a sliding shaft 23 and connected to a spring 24 on one end thereof. The cash counting apparatus of the present invention further comprises a swing arm 4 with a driving groove 43 on one end thereof and the driving pin 33 passes through the driving groove 43. The swing arm 4 has a pivotal hole 41 at center thereof and pivotally assembled to a pivot 55 of a baffle plate 50. The swing arm 4 has a probe 42 on another end thereof and made of flexible and electrically conductive material.

The probe 42 can be swung alone the pivot 41 and in contact with one of contacts 51, 52, 53, and 54 on a circuit board 5. The baffle plate 50 is arranged on one side of a case 2 in the box 1. The probe 42 can be integrally formed with the swing arm 4.

Figure 3:
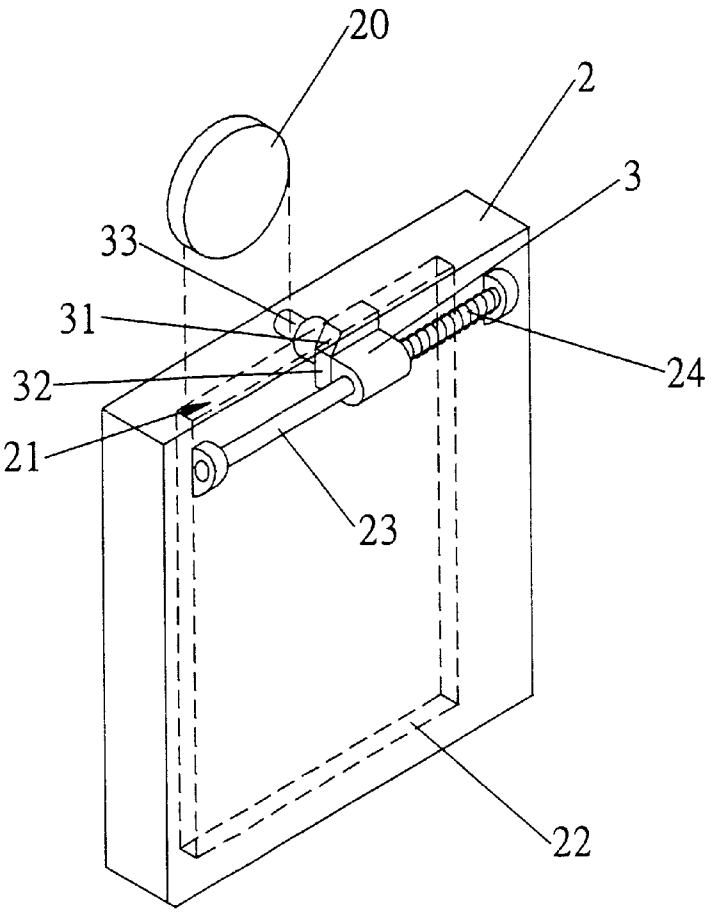
FIG. 3 shows a perspective view of the cash counting apparatus of the present invention.

With reference to FIG. 3, the case 2 has a passage 2 for the coin 20 inserted therein. The sliding block 3 is movably arranged on a sliding shaft 23 in upper portion of the case 2. The inserted coin 20 will push the bevel 31 firstly and then push the pushing face 32. The sliding block 3 has different lateral moving stroke depending on the value and size of the coin 20 and is restored by the spring 24.

Figure 4:
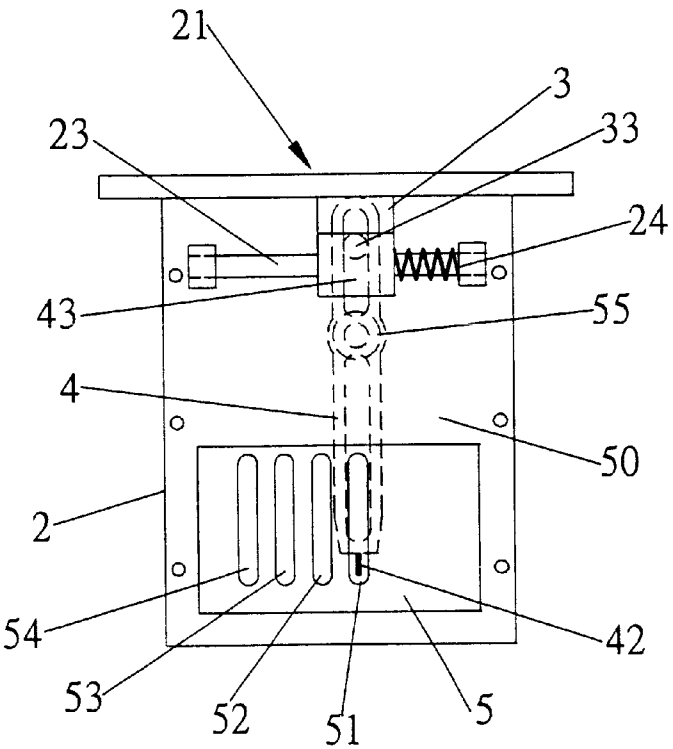
FIG. 4 shows a sectional view of the cash counting apparatus of the present invention.

With reference to FIG. 4, the sliding block 3 is pushed laterally by the inserted coin 20 and the swing arm 4 is driven by the driving pin 33 of the sliding block 3 through the driving groove 43. The moving distance of the driving groove 43, i.e., the swing extent of the swing arm 4 depends on the sizes of the coins.

The inserted coin 20 first pushes the sliding block 3 and the probe 42 is also moved with amplified swing due to the lever action of the swing arm 4. When the coin 20 has the smallest value, the probe 42 is in contact with the rightmost contact 51. If coin 20 has other value, the probe 42 may, for example, be in contact with the contact 53. . When the coin 20 has the largest value, the probe 42 is in contact with the leftmost contact 54. The contacts 51–54 can be connected to a sum circuit (not shown) to sum the value of the total coins.

Figure 5:
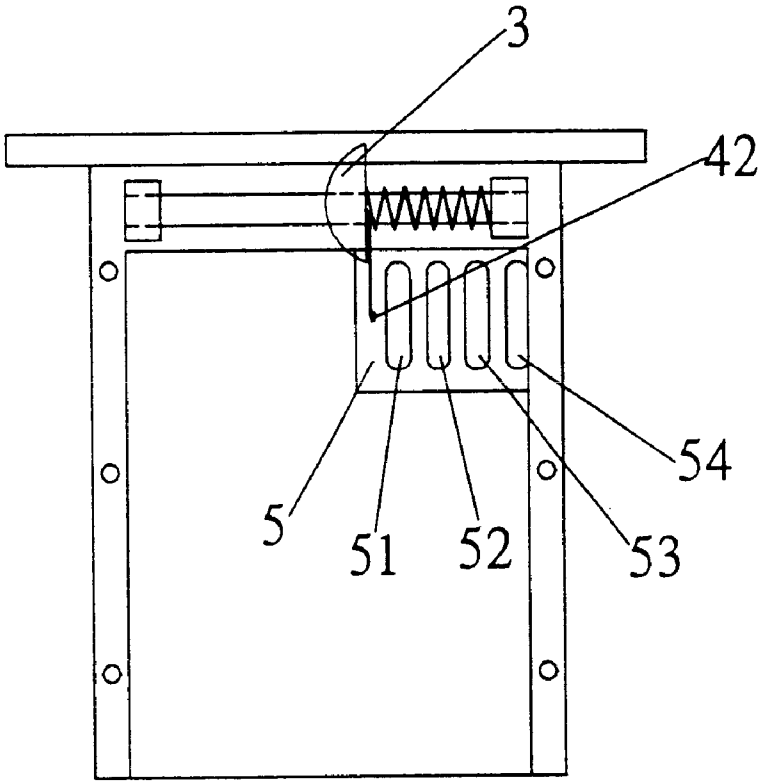
FIG. 5 shows a sectional view of the cash counting apparatus of another preferred embodiment of the present invention.

As shown in FIG. 5, if the sizes of coins with different value have sufficient differences, the circuit board 5 is directly placed below the sliding block 3 and the sliding block 3 has a probe 42 thereon. In similar manner, the coins of different sizes will drive the probe 42 to be in contact with the contacts 51–54, respectively.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A cash counting apparatus for cashbox, comprising a case arranged within the cashbox;

a sliding block movably arranged at an upper side of the case and restored by a spring;

a swing arm pivotally arranged on a baffle plate in the case and having a first end pivotally driven by the sliding block and a probe on a second end opposite to the first end thereof;

a circuit board with a plurality of contacts;

the swing arm being driven by the sliding block such that the probe is selectively in contact with one of the contacts.

2. The cash counting apparatus for cashbox as in claim 1, wherein the sliding block is movably arranged on a sliding shaft in the case.

3. The cash counting apparatus for cashbox as in claim 1, wherein the sliding block has a driving pin on one face thereof and fit into a driving groove on the first end of the swing arm.

4. The cash counting apparatus for cashbox as in claim 1, wherein the sliding block has a bevel on which an inserted coin pushes and a pushing face adjacent to the bevel.

5. The cash counting apparatus for cashbox as in claim 1, wherein the sliding block also has a probe thereon.

* * * * *